US006282994B1

(12) United States Patent
Wei

(10) Patent No.: US 6,282,994 B1
(45) Date of Patent: Sep. 4, 2001

(54) SOCKET

(76) Inventor: Chiao Wei, 189, Industry Rd., Taipin City 411 (Ta Li Ind. Park), Taichung (TW)

( * ) Notice: Subject to any disclaimer, the term of this patent is extended or adjusted under 35 U.S.C. 154(b) by 0 days.

(21) Appl. No.: 09/542,832

(22) Filed: Apr. 4, 2000

(51) Int. Cl.[7] ..... B25B 13/06
(52) U.S. Cl. ..... 81/121.1
(58) Field of Search ..... 81/120, 121.1, 81/124.3

(56) References Cited

U.S. PATENT DOCUMENTS 1,658,886 * 2/1928 Dickey ..... 81/121.1
3,121,355 * 2/1964 Morel et al. ..... 81/176.2
3,678,789 * 7/1972 Wilson ..... 81/64
4,602,534 * 7/1986 Moetteli ..... 81/177.85
4,825,732 * 5/1989 Arnold ..... 81/121.1
4,867,017 * 9/1989 Holman ..... 81/121.1
5,079,978 * 1/1992 Kupfer ..... 81/119
5,199,331 * 4/1993 Tsukamoto ..... 81/121.1
5,271,299 * 12/1993 Wadsworth ..... 81/121.1
5,287,775 * 2/1994 Moore ..... 81/121.1
5,367,925 * 11/1994 Gasparre ..... 81/121.1
5,692,419 * 12/1997 Binns ..... 81/124.3

* cited by examiner

*Primary Examiner*—Derris H. Banks
*Assistant Examiner*—David B Thomas
(74) *Attorney, Agent, or Firm*—Rosenberg, Klein & Lee

(57) ABSTRACT

A socket includes an outer periphery formed with a contact surface for increasing friction on the outer periphery of the socket. In such a manner, when a small torsion is required to operate a workpiece such as a nut and the like, the socket can be fitted on the workpiece so as to directly operate the workpiece such that a user can use the contact surface to enhance the friction between the socket and the user's hand, thereby facilitating the user gripping the outer periphery of the socket to rotate the socket so as to slightly tighten or loosen the workpiece without a need to use an additional tool such as a socket wrench.

1 Claim, 17 Drawing Sheets

SOCKET

BACKGROUND OF THE INVENTION

1. Field of the Invention

The present invention relates to a socket, and more particularly to a socket having a contact surface for increasing friction on the outer periphery of the socket.

2. Description of the Related Art

A conventional socket 10 in accordance with the prior art shown in FIG. 17 has a hexagonal recess 11 defined in one end thereof, and has thickest portion 12 and a thinnest portion 13. In use, the socket 10 can be fitted on a workpiece such as a nut, a bolt or the like. A user can then hold the outer periphery of the socket 10 to rotate the socket 10 around a number of turns so as to slightly tighten the workpiece manually. Then, the socket 10 is operated in conjunction with a socket wrench so as to tighten the workpiece. However, the outer periphery of the socket 10 is often made round with a smooth surface so that the use cannot securely hold the outer periphery of the socket, thereby causing easily inconvenience when the user rotates the socket 10.

The present invention has arisen to mitigate and/or obviate the disadvantage of the conventional socket.

BRIEF SUMMARY OF THE INVENTION

In accordance with one aspect of the present invention, there is provided a socket having an outer periphery formed with a contact surface for increasing friction on the outer periphery of the socket.

By such an arrangement, when a small torsion is required to operate a workpiece such as a nut and the like, the socket can be fitted on the workpiece so as to directly operate the workpiece such that a user can use the contact surface to enhance the friction between the socket and the user's hand, thereby facilitating the user gripping the outer periphery of the socket to rotate the socket so as to slightly tighten or loosen the workpiece without a need to use an additional tool such as a socket wrench.

The contact surface longitudinally extends through the length of the outer periphery of the socket. Alternatively, the contact surface longitudinally extends through one half of the length of the outer periphery of the socket.

According to an embodiment of the present invention, the contact surface includes a plurality of lengthwise semicircular ribs adjacently arranged with each other.

According to another embodiment of the present invention, the contact surface includes a plurality of lengthwise ribs spaced from each other.

According to a further embodiment of the present invention, the contact surface has a star-like configuration.

According to a further embodiment of the present invention, the contact surface includes a plurality of lengthwise inclined planes spaced from each other, and a plurality of lengthwise flat planes each located between two adjacent inclined planes.

According to a further embodiment of the present invention, the contact surface includes a plurality of lengthwise inclined planes spaced from each other, and a plurality of lengthwise ribs each located between two adjacent inclined planes.

According to a further embodiment of the present invention, the contact surface includes a plurality of lengthwise inclined planes spaced from each other, and a plurality of lengthwise arcuate recesses each located between two adjacent inclined planes.

Further benefits and advantages of the present invention will become apparent after a careful reading of the detailed description with appropriate reference to the accompanying drawings.

DETAILED DESCRIPTION OF THE INVENTION

Figure 1:
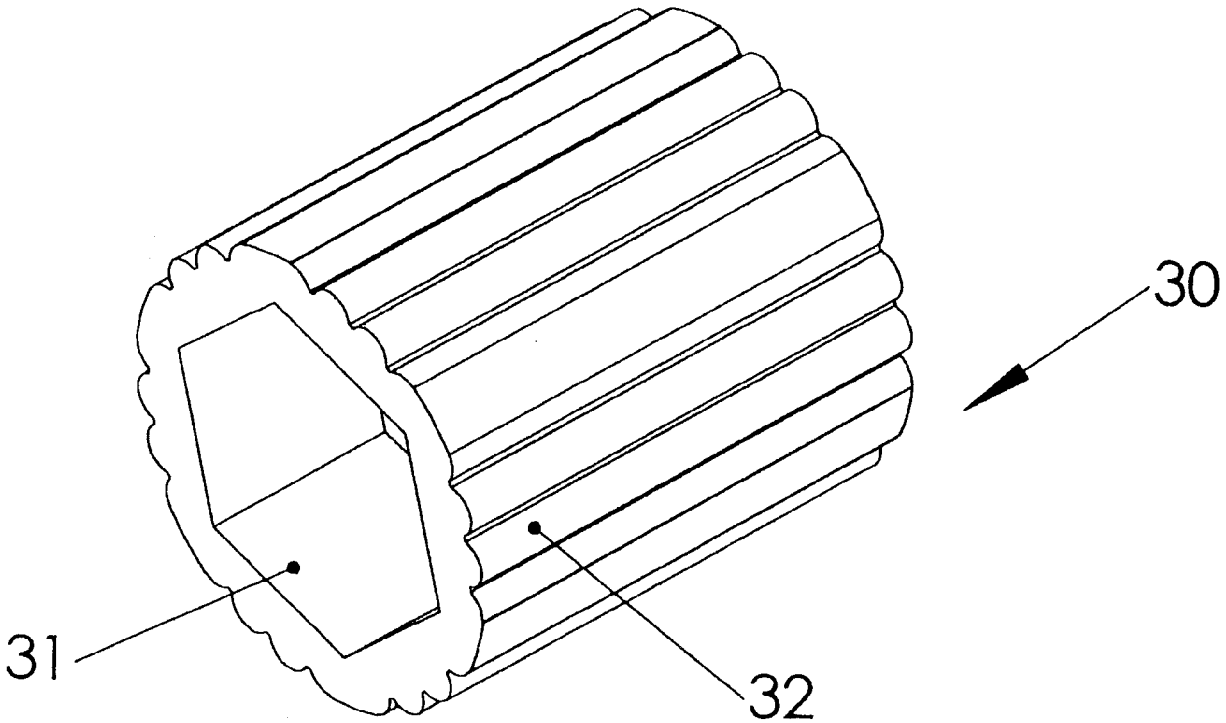
FIG. 1 is a perspective view of a socket in accordance with an embodiment of the present invention.
Figure 2:
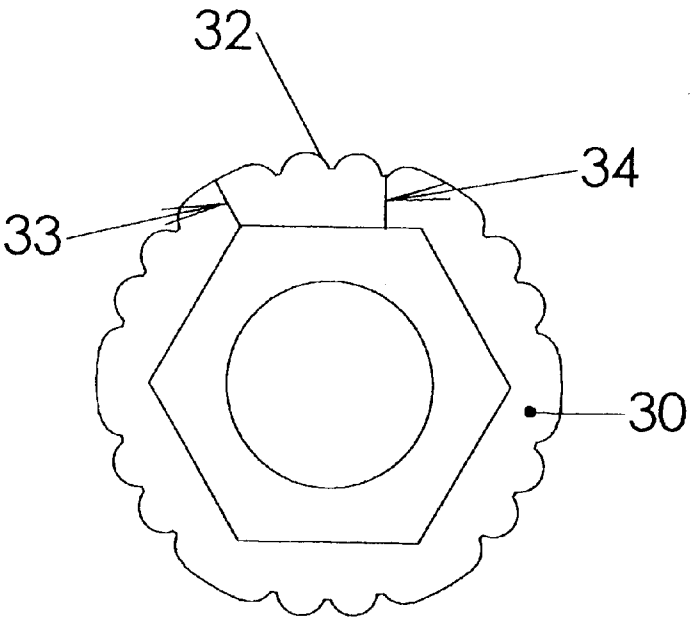
FIG. 2 is a front plan view of the socket as shown in FIG. 1.

Referring to the drawings and initially to FIGS. 1 and 2, a socket 30 in accordance with an embodiment of the present invention comprises an inner periphery defining a hexagonal recess 31, and an outer periphery formed with a contact surface 32 for increasing friction on the outer periphery of the socket 30.

Preferably, the contact surface 32 longitudinally extends through the length of the outer periphery of the socket 30. Alternatively, the contact surface 32 can also longitudinally extend through one half of the length of the outer periphery of the socket 30.

Accordingly, in such a manner, when a small torsion is required to manually operate (slightly tighten or loosen) a workpiece such as a nut, a bolt, and the like, the socket 30 can be fitted on the workpiece so as to directly operate the workpiece such that a user can use the contact surface 32 to enhance the friction between the socket 30 and the user's hand, thereby facilitating the user gripping the outer periphery of the socket 30 to rotate the socket 30 so as to slightly tighten or loosen the workpiece manually without a need to use an additional tool such as a socket wrench.

When a greater torsion is required to tighten or loosen the workpiece, the user can grip the contact surface 32 to rotate the socket 30 around a number of turns so as to slightly tighten the workpiece manually, and then the socket 30 can be operated in conjunction with a socket wrench so as to tighten the workpiece.

Especially referring to FIG. 2, the location of the contact surface 32 is away from the thinnest corners 33 of the socket 30. The contact surface 32 also forms multiple thinnest portions 34. Preferably, the thickness of the thinnest portion 34 is greater than that of the thinnest corner 33 so that the socket 30 can maintain its original bearing torsion.

Figure 3:
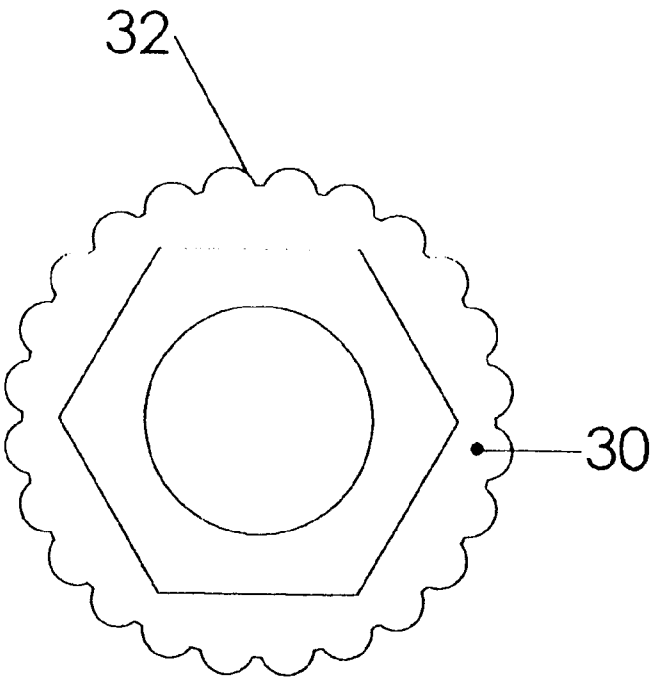
FIG. 3 is a front plan view of a socket in accordance with another embodiment of the present invention.

Referring to FIG. 3, in accordance with another embodiment of the resent invention, the contact surface 32 includes a plurality of lengthwise semi-circular ribs adjacently arranged with each other.

Figure 4:
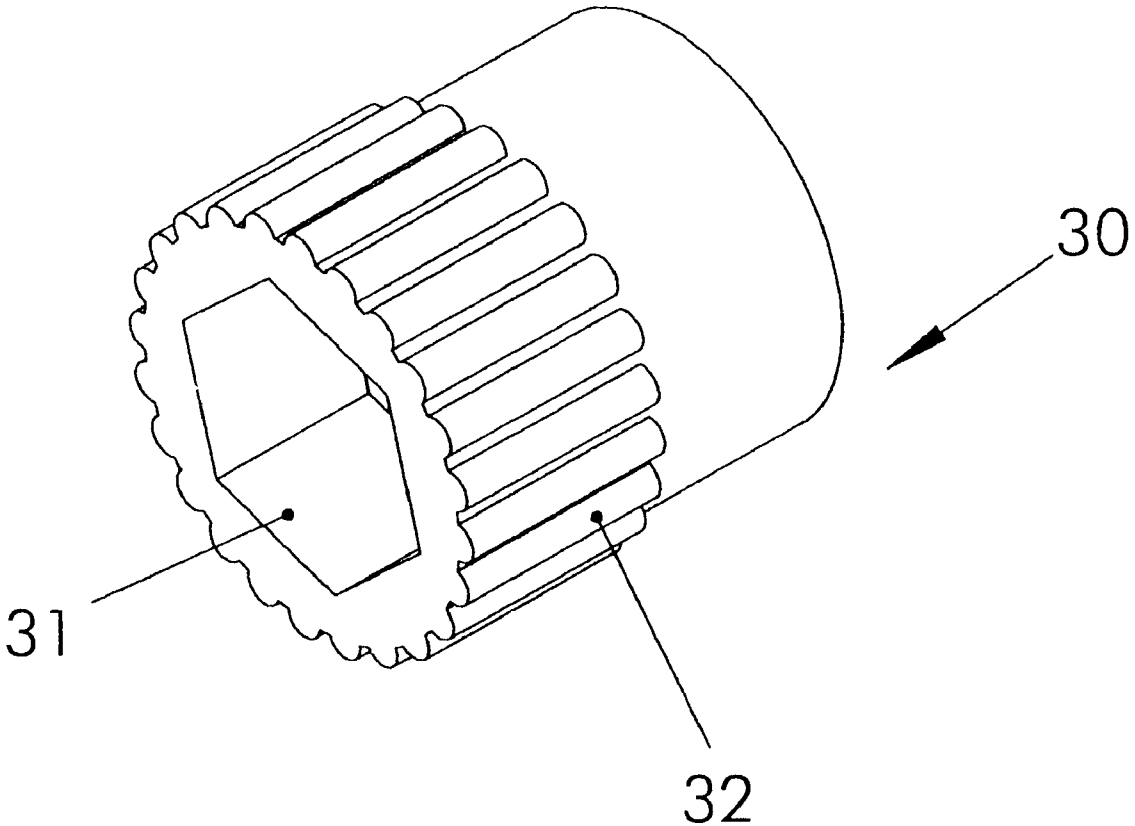
FIG. 4 is a perspective view of a socket in accordance with a further embodiment of the present invention.

Referring to FIG. 4, in accordance with a further embodiment of the present invention, the ribs of the contact surface 32 longitudinally extend through one half of the length of the outer periphery of the socket 30.

Figure 5:
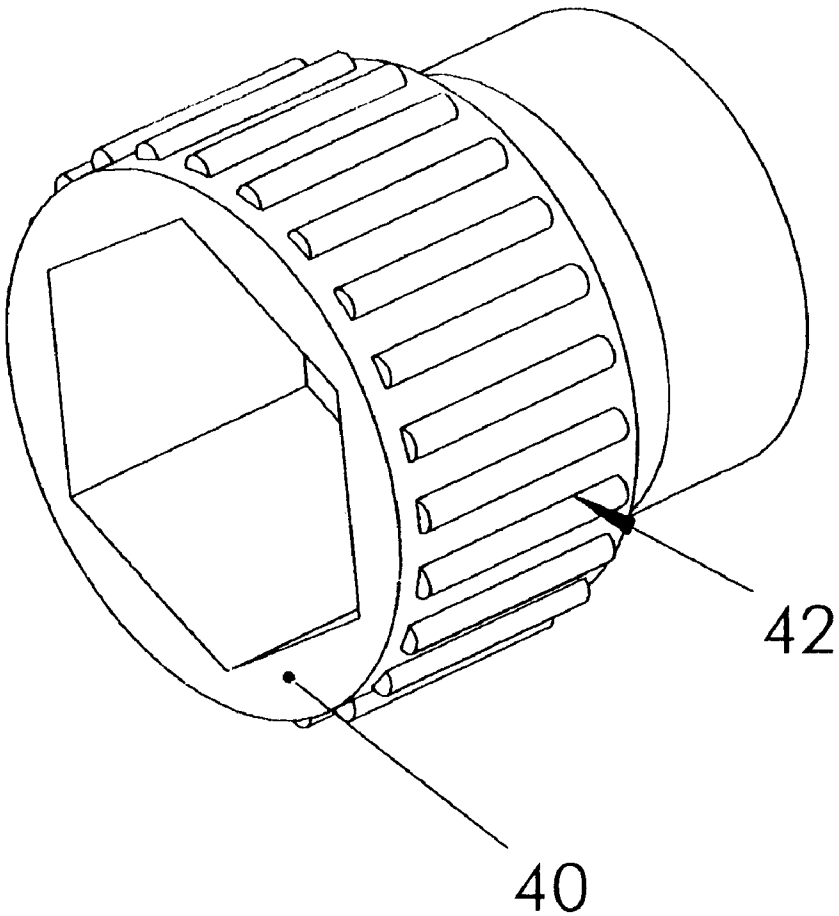
FIG. 5 is a perspective view of a socket in accordance with a further embodiment of the present invention.

Referring to FIG. 5, in accordance with a further embodiment of the present invention, the contact surface 42 of a socket 40 includes a plurality of lengthwise ribs spaced from each other.

Figure 6:
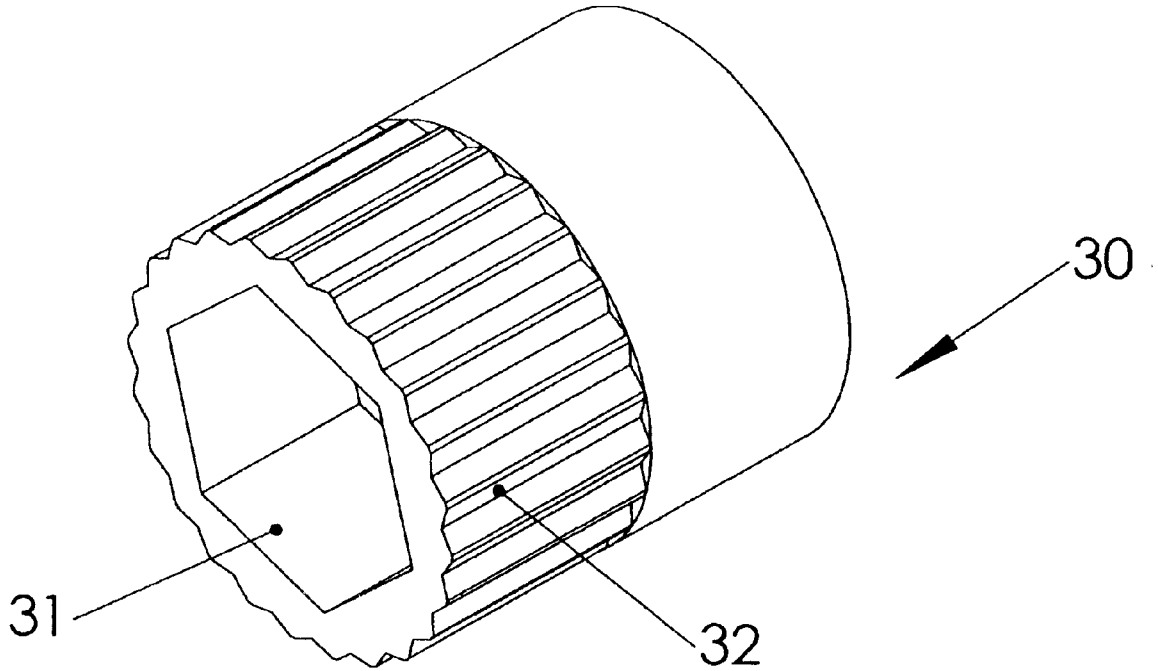
FIG. 6 is a perspective view of a socket in accordance with a further embodiment of the present invention.

Referring to FIG. 6, in accordance with a further embodiment of the present invention, the contact surface 32 of the socket 30 has a star-like configuration.

Figure 7:
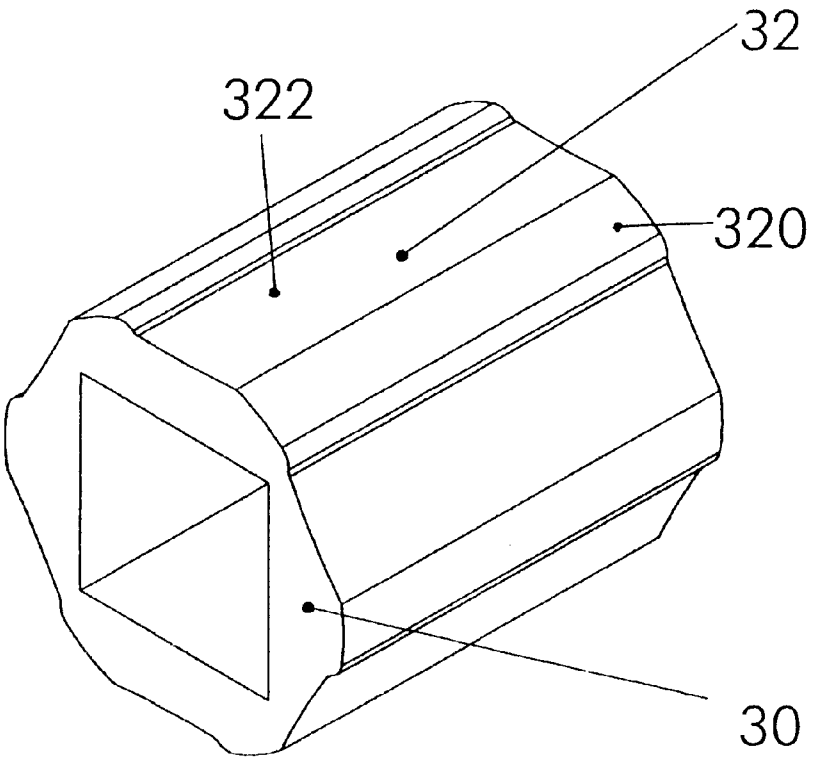
FIG. 7 is a perspective view of a socket in accordance with a further embodiment of the present invention.

Referring to FIG. 7, in accordance with a further embodiment of the present invention, the contact surface 32 of the socket 30 includes a plurality of lengthwise inclined planes 320 spaced from each other, and a plurality of lengthwise flat planes 322 each located between two adjacent inclined planes 320.

Figure 8:
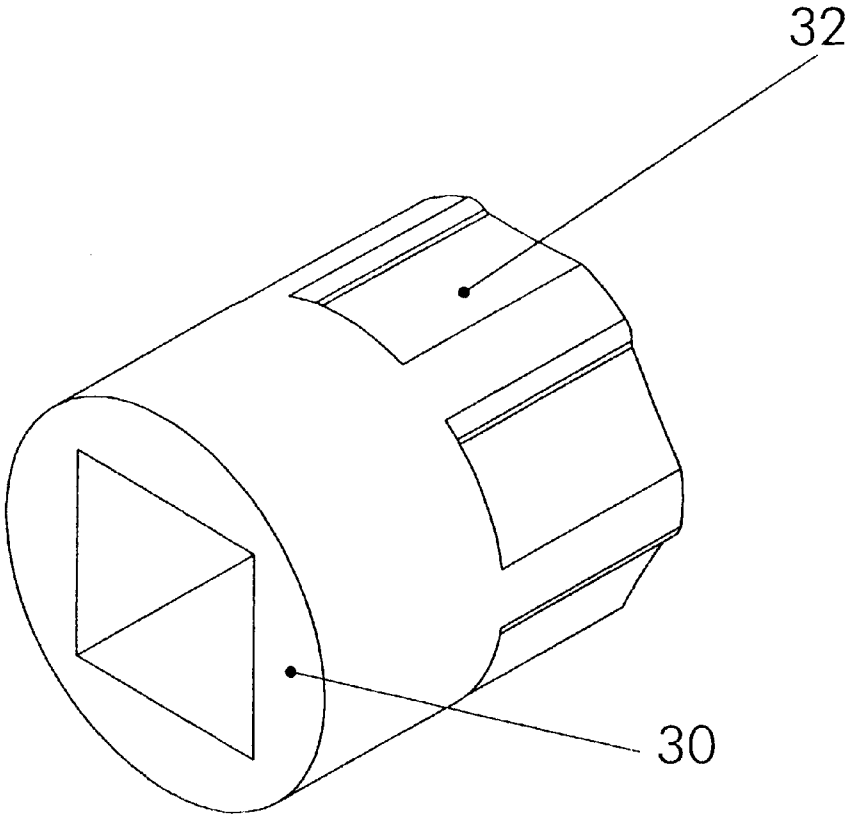
FIG. 8 is a perspective view of a socket in accordance with a further embodiment of the present invention.

Referring to FIG. 8, in accordance with a further embodiment of the present invention, the contact surface 32 longitudinally extends through one half of the length of the outer periphery of the socket 30.

Figure 9:
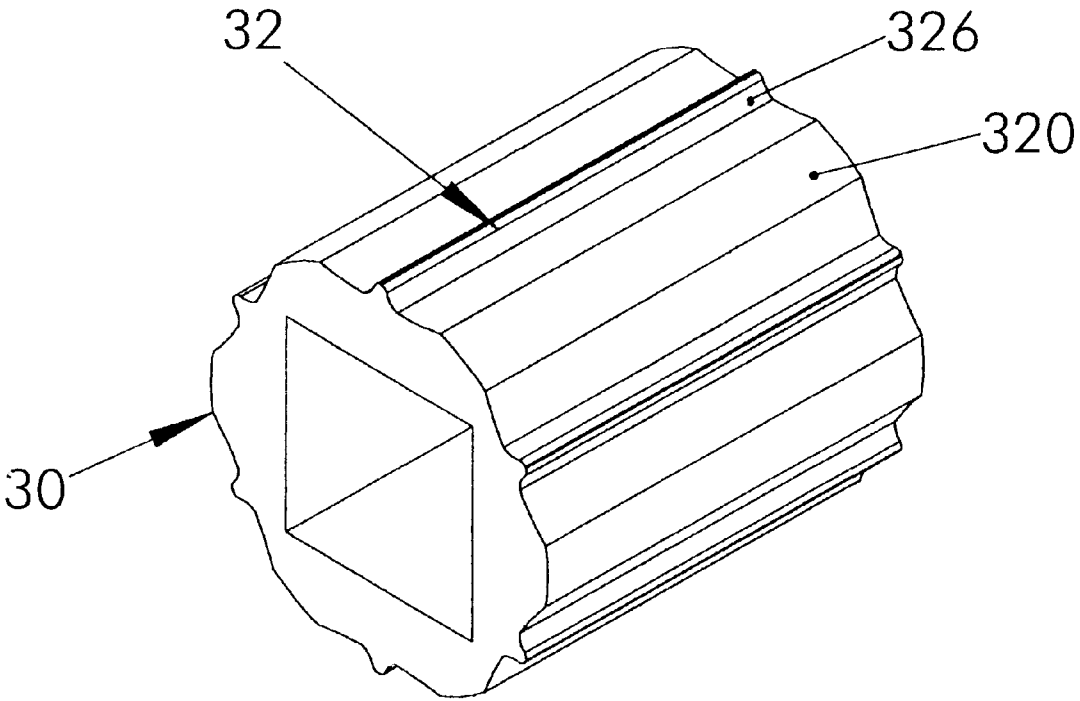
FIG. 9 is a perspective view of a socket in accordance with a further embodiment of the present invention.

Referring to FIG. 9, in accordance with a further embodiment of the present invention, the contact surface 32 includes a plurality of lengthwise inclined planes 320 spaced from each other, and a plurality of lengthwise ribs 326 each located between two adjacent inclined planes 320.

Figure 10:
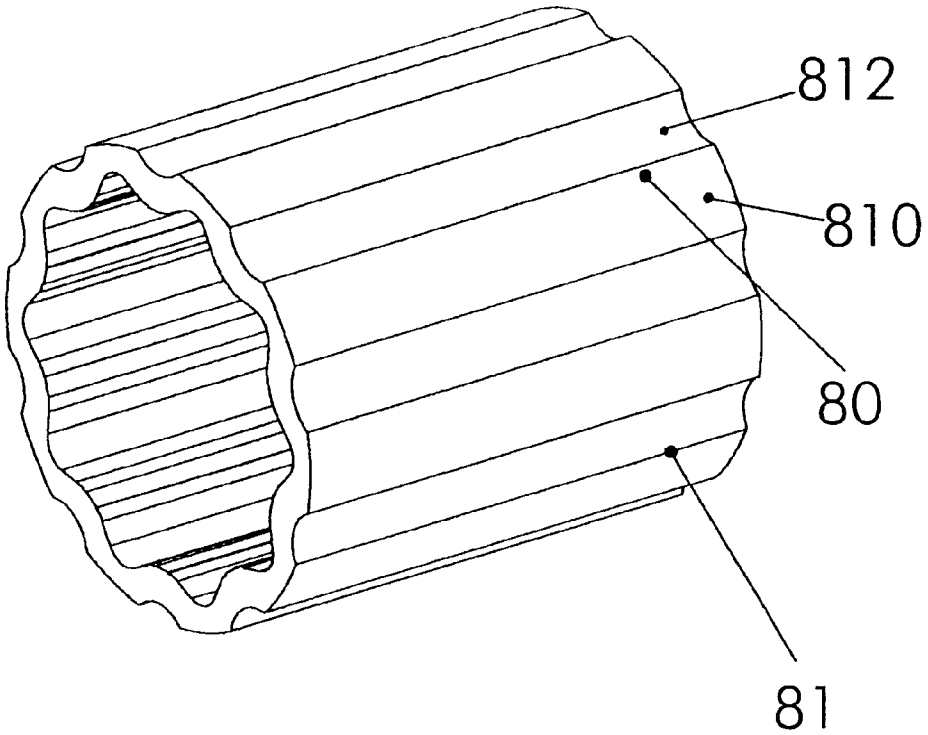
FIG. 10 is a perspective view of a socket in accordance with a further embodiment of the present invention.

Referring to FIG. 10, in accordance with a further embodiment of the present invention, the contact surface 81 of a socket 80 includes a plurality of lengthwise inclined planes 810 spaced from each other, and a plurality of lengthwise arcuate recesses 812 each located between two adjacent inclined planes 810.

Figure 11:
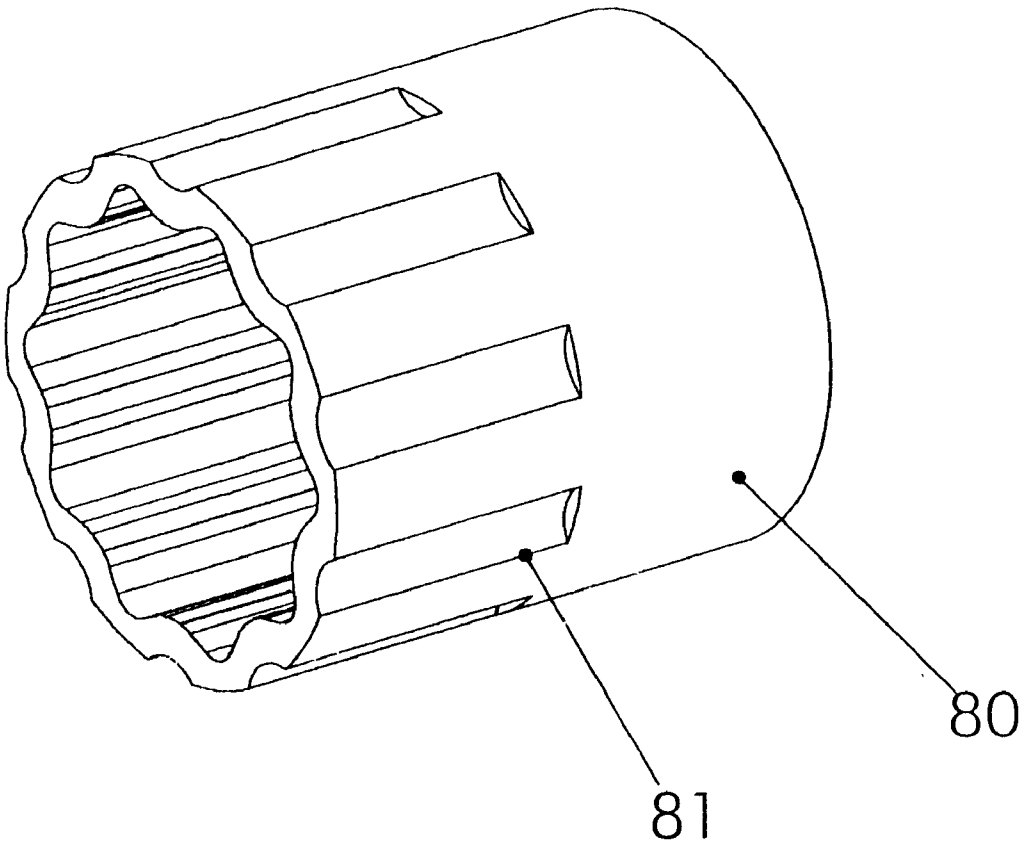
FIG. 11 is a perspective view of a socket in accordance with a further embodiment of the present invention.

Referring to FIG. 11, in accordance with a further embodiment of the present invention, the contact surface 81 longitudinally extends through one half of the length of the outer periphery of the socket 80.

Figure 12:
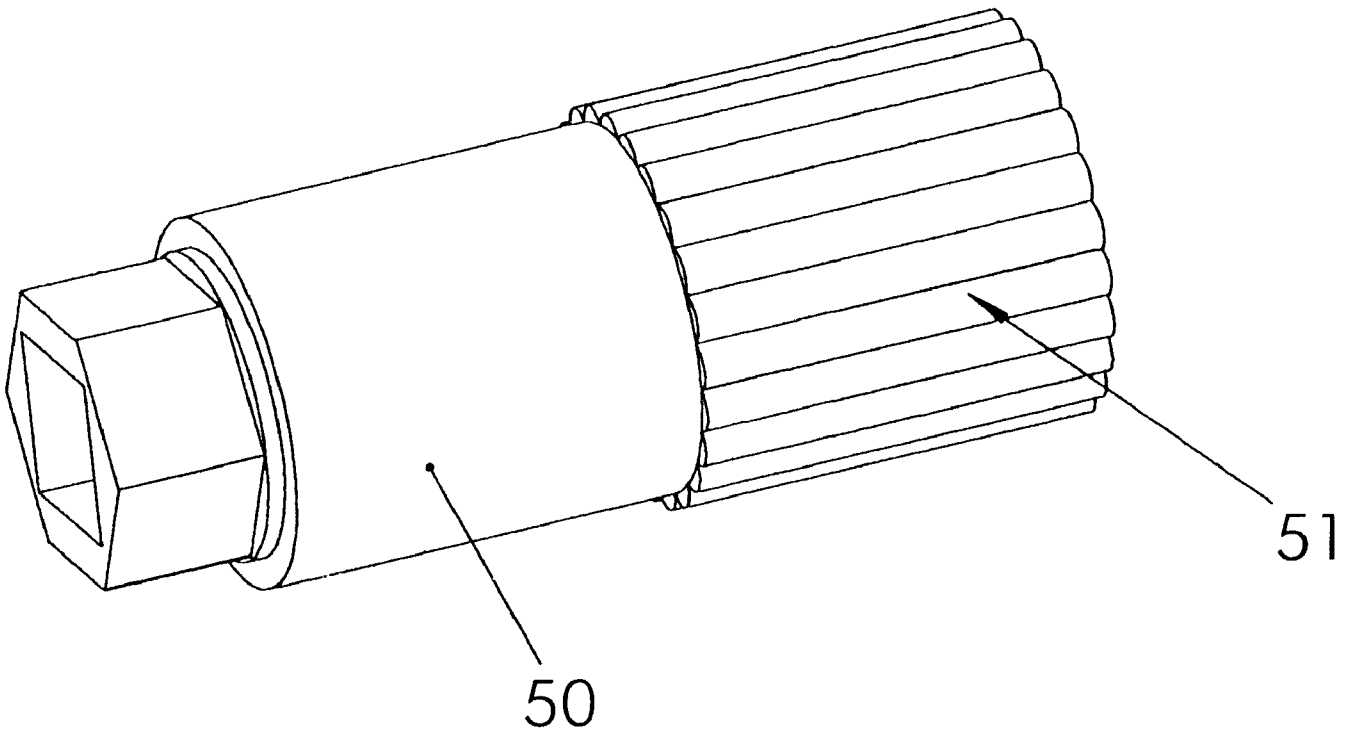
FIG. 12 is a perspective view of a spark plug socket in accordance with a further embodiment of the present invention.

Referring to FIG. 12, in accordance with a further embodiment of the present invention, a spark plug socket 50 includes a contact surface 51.

Figure 13:
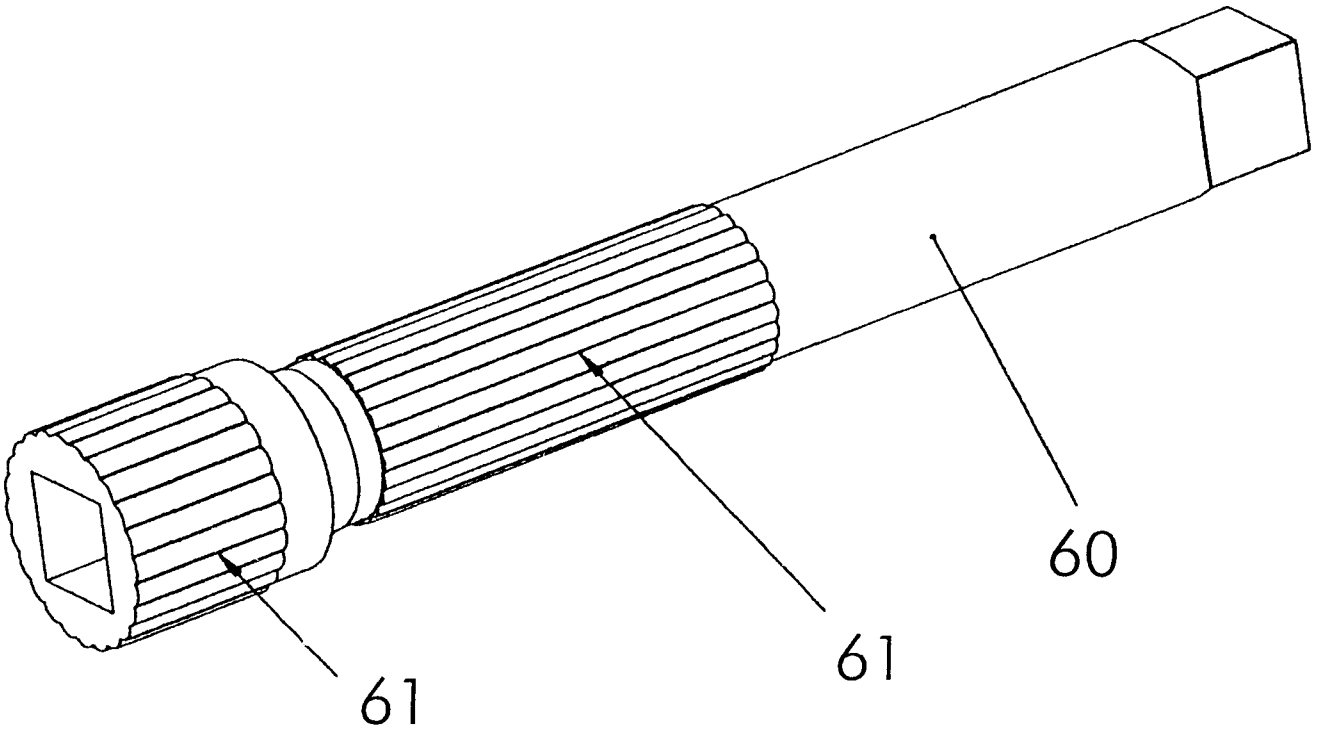
FIG. 13 is a perspective view of a connecting rod in accordance with a further embodiment of the present invention.

Referring to FIG. 13, in accordance with a further embodiment of the present invention, a connecting rod 60 includes a contact surface 61.

Figure 14:
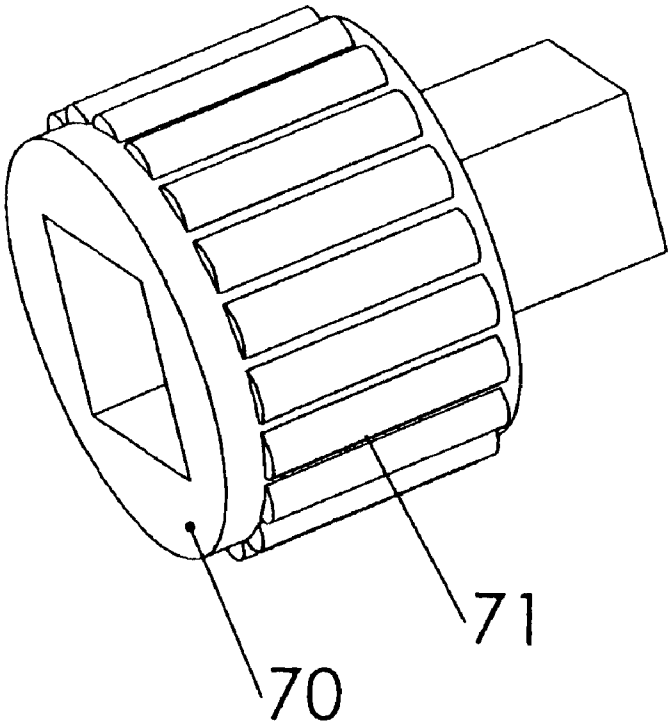
FIG. 14 is a perspective view of a connector in accordance with a further embodiment of the present invention.

Referring to FIG. 14, in accordance with a further embodiment of the present invention, a connector 70 includes a contact surface 71 longitudinally extending through the length of the outer periphery of the connector 70.

Figure 15:
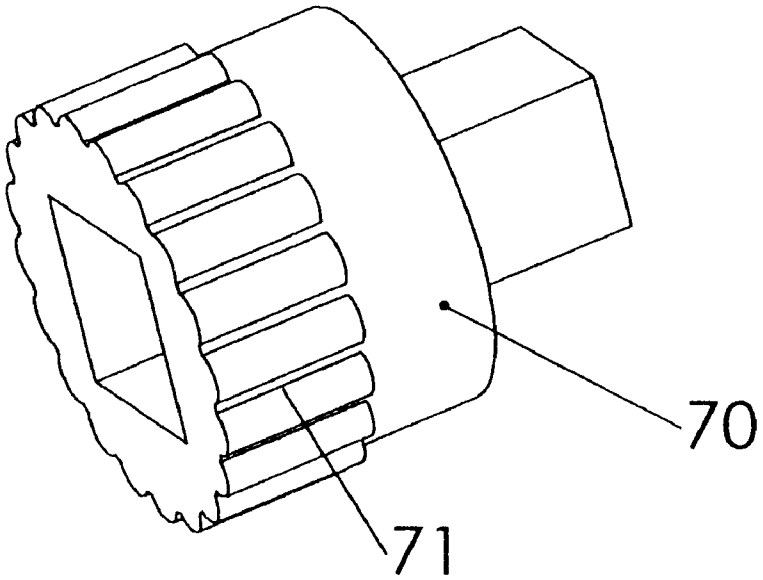
FIG. 15 is a perspective view of a connector in accordance with a further embodiment of the present invention.

Referring to FIG. 15, in accordance with a further embodiment of the present invention, the contact surface 71 longitudinally extends through one half of the length of the outer periphery of the connector 70.

Figure 16:
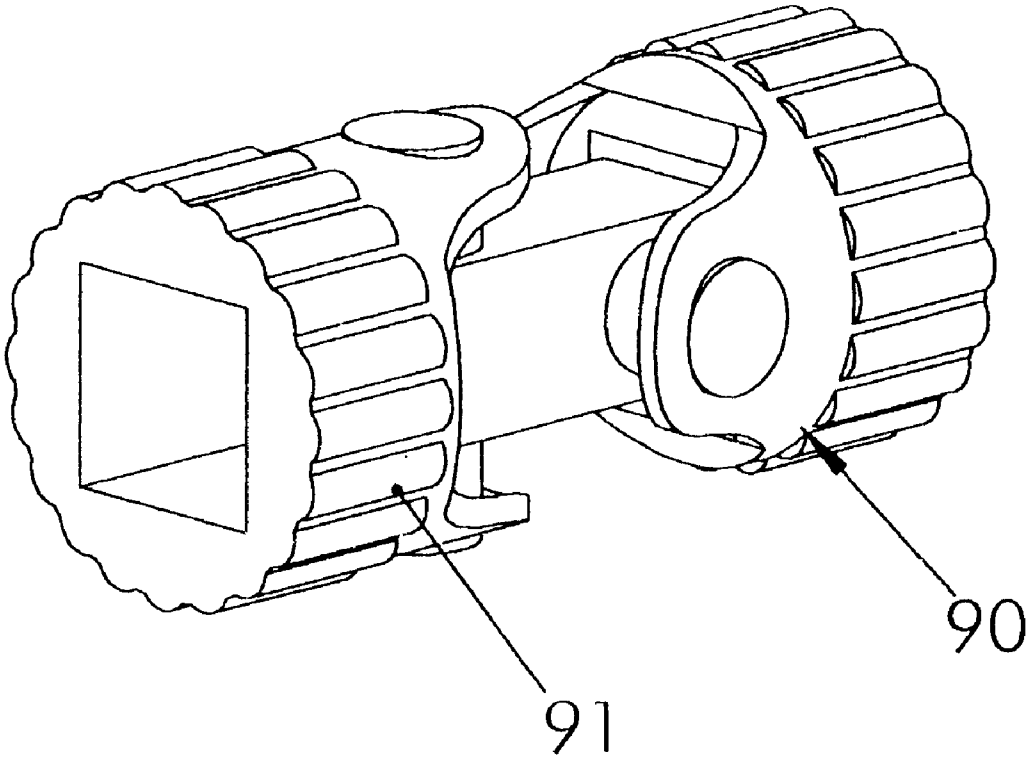
FIG. 16 is a perspective view of a universal connector in accordance with a further embodiment of the present invention.
Figure 17:
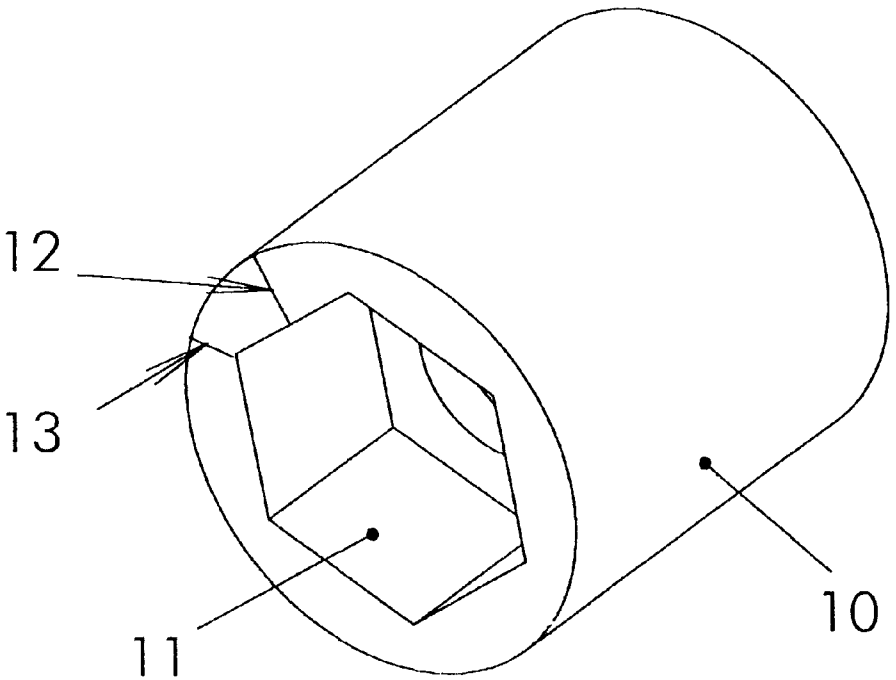
FIG. 17 PRIOR ART
FIG. 17 is a perspective view of a conventional socket in accordance with the prior art.

Referring to FIG. 16, in accordance with a further embodiment of the present invention, a universal connector 90 includes a contact surface 91.

It should be clear to those skilled in the art that further embodiments may be made without departing from the scope of the present invention.

What is claimed is:

1. A socket having an outer periphery formed with a contact surface for increasing friction on said outer periphery of said socket, said contact surface including a plurality of lengthwise inclined planes spaced from each other, and a plurality of lengthwise arcuate recesses spaced from each other and each located between any two adjacent inclined planes, such that each of said inclined planes and each of said arcuate recesses are staggered with each other.

* * * * *